US005387133A

United States Patent [19]

Tondreault et al.

[11] Patent Number: 5,387,133

[45] Date of Patent: Feb. 7, 1995

[54] TERMINAL FOR LOW PROFILE EDGE SOCKET

[75] Inventors: Robert J. Tondreault, Louisville, Ky.; James F. DePriest, New Albany, Ind.

[73] Assignee: Robinson Nugent, Inc., New Albany, Ind.

[21] Appl. No.: 120,656

[22] Filed: Sep. 13, 1993

Related U.S. Application Data

[63] Continuation of Ser. No. 759,409, Sep. 13, 1991, Pat. No. 5,254,017.

[51] Int. Cl.[6] ..... H01R 23/70

[52] U.S. Cl. ..... 439/637; 439/751; 439/862

[58] Field of Search ..... 439/630–637, 439/326–328, 751, 59, 62, 861, 862

[56] References Cited

U.S. PATENT DOCUMENTS

| | | | |
|---|---|---|---|
| Re. 26,692 | 10/1969 | Ruehlemann . | |
| 2,875,425 | 2/1959 | Gilbert . | |
| 3,127,228 | 3/1964 | Greco et al. . | |
| 3,199,066 | 8/1965 | Eledge et al. . | |
| 3,215,968 | 11/1965 | Herrmann . | |
| 3,231,848 | 1/1966 | Ruehlemann . | |
| 3,567,998 | 3/1971 | Ammerman . | |
| 3,617,992 | 11/1971 | Ruehlemann . | |
| 3,732,531 | 5/1973 | Bouley . | |
| 4,075,759 | 2/1978 | Sochor . | |
| 4,220,382 | 9/1980 | Ritchie et al. . | |
| 4,725,250 | 2/1988 | Kuhn et al. . | |
| 4,737,120 | 4/1988 | Grabbe et al. . | |
| 4,804,334 | 2/1989 | Alexeenko et al. . | |
| 4,826,446 | 5/1989 | Juntwait . | |
| 4,869,672 | 9/1989 | Andrews, Jr. . | |
| 4,946,403 | 8/1990 | Billman et al. | 439/326 |
| 4,973,270 | 11/1990 | Billman et al. . | |
| 4,984,996 | 1/1991 | Watanabe et al. . | |
| 4,990,097 | 2/1991 | Billman et al. . | |
| 5,013,264 | 5/1991 | Tondreault . | |
| 5,026,292 | 6/1991 | Pickles et al. . | |
| 5,041,005 | 8/1991 | McHugh | 439/326 |
| 5,057,032 | 10/1991 | Kaufman et al. . | |
| 5,064,381 | 11/1991 | Lin . | |
| 5,082,459 | 1/1992 | Billman et al. . | |

FOREIGN PATENT DOCUMENTS

| | | |
|---|---|---|
| 2038559 | 4/1971 | Germany . |
| 2093641 | 9/1982 | United Kingdom . |

*Primary Examiner*—David L. Pirlot
*Attorney, Agent, or Firm*—Barnes & Thornburg

[57] ABSTRACT

A terminal is provided which includes includes an a non-movable L-shaped base and a swan neck contact coupled to one end of the base. The terminal also includes a split dimple formed on a base of the terminal to provide a front-to-back alignment of the terminal inside terminal-receiving cavities formed in a socket housing. The split dimple also provides the terminal with a strong retention to the plastic body of the connector housing. The terminals are particularly useful in a SIMM socket. Adjacent terminals on opposite sides of the edge card are electrically isolated or independent from each other. By incorporating electrically independent contacts into a SIMM socket, the present invention permits twice as many I/O leads in the same amount of space compared to a conventional SIMM socket and doubles the number of pads per module.

16 Claims, 3 Drawing Sheets

TERMINAL FOR LOW PROFILE EDGE SOCKET

This is a continuation of application Ser. No. 07/759,409 filed Sept. 13, 1991. U.S. Pat. No. 5,254,017.

BACKGROUND AND SUMMARY OF THE INVENTION

The present invention relates to an electronic connector, and in particular, to a single in-line memory module (SIMM) socket for receiving a circuit board, module, or edge card therein. More particularly, the present invention relates to a terminal designed for use in a socket so that the socket has a higher density and an increased output compared to conventional sockets.

SIMM sockets that are used to couple two printed circuit boards together are well known. One such SIMM socket is illustrated in U.S. Pat. No. 5,013,264 which is assigned to the same assignee as the present invention. The electronic industry constantly demands smaller and smaller components in a continuing effort to miniaturize. The present invention is an improvement over existing SIMM sockets in that the contacts or terminals are configured to permit twice as many input-/output (I/O) leads in the same amount of space as a conventional SIMM socket. The connector of the present invention takes up about 65% less space than conventional connectors and includes its own built-in card guides. The terminals are designed so that the functional range of performance is not compromised due to the reduced size.

According to one aspect of the present invention, the terminal includes a non-movable generally L-shaped base and a swan neck contact coupled to one end of the base. The swan neck contact includes a tapered functional portion or spring section and is designed so that the mechanical stresses imparted on the contact during insertion of an edge card are distributed throughout the entire length of the swan neck to maximize the range of performance and mechanical stability.

Another aspect of the present invention is the provision of a "split dimple" formed on a base portion of the terminal to provide a front-to-back alignment of the terminal inside terminal-receiving cavities formed in the socket housing. The split dimple also provides the terminal with a strong retention to the plastic body of the connector housing. During the molding of plastic components to form the plastic socket housing, warping of the plastic often occurs due to shrinkage of the plastic during the cooling process. This warpage can be seen as a frown in the part. Advantageously, the split dimple of the present invention provides an opposing front-to-back force which, when the connector housing is fully loaded with terminals, eliminates the frown. The split dimple also centers the terminals within the terminal-receiving cavities in the housing.

Yet another aspect of the present invention is that the socket housing is formed to include integral stabilizing beams which are flexible to grip and hold a circuit board, module, or edge card in a stable vertical position. These stabilizing beams permit a reduction in the height of the SIMM socket. This stabilizing beam feature by itself is well known in the art. However, the electrically independent terminals of the present invention, when used in a SIMM socket which includes the stabilizing beams, provides significant advantages in reducing the size of the socket while increasing the number of I/O leads.

Conventional SIMM sockets are designed such that conductive pads on opposite sides of a module or edge card are electrically interconnected. Conventional SIMM sockets incorporate contacts with opposed beams comprising a redundant interface for engaging conductive pads on opposite sides of the module or edge card. In other words, the opposed beams in conventional SIMM sockets are coupled electrically. Redundancy in conventional SIMM sockets provides assurance of noninteruptive electrical connection.

In the present invention, contacts on opposite sides of the edge card received in the socket are electrically isolated or independent from each other. By incorporating electrically independent contacts into a SIMM socket, the present invention permits twice as many I/O leads in the same amount of space compared to a conventional SIMM socket and doubles the number of pads per module. The terminals of the present invention are discrete instead of "dual" opposed or redundant as in conventional SIMM sockets.

Additional objects, features, and advantages of the invention will be become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
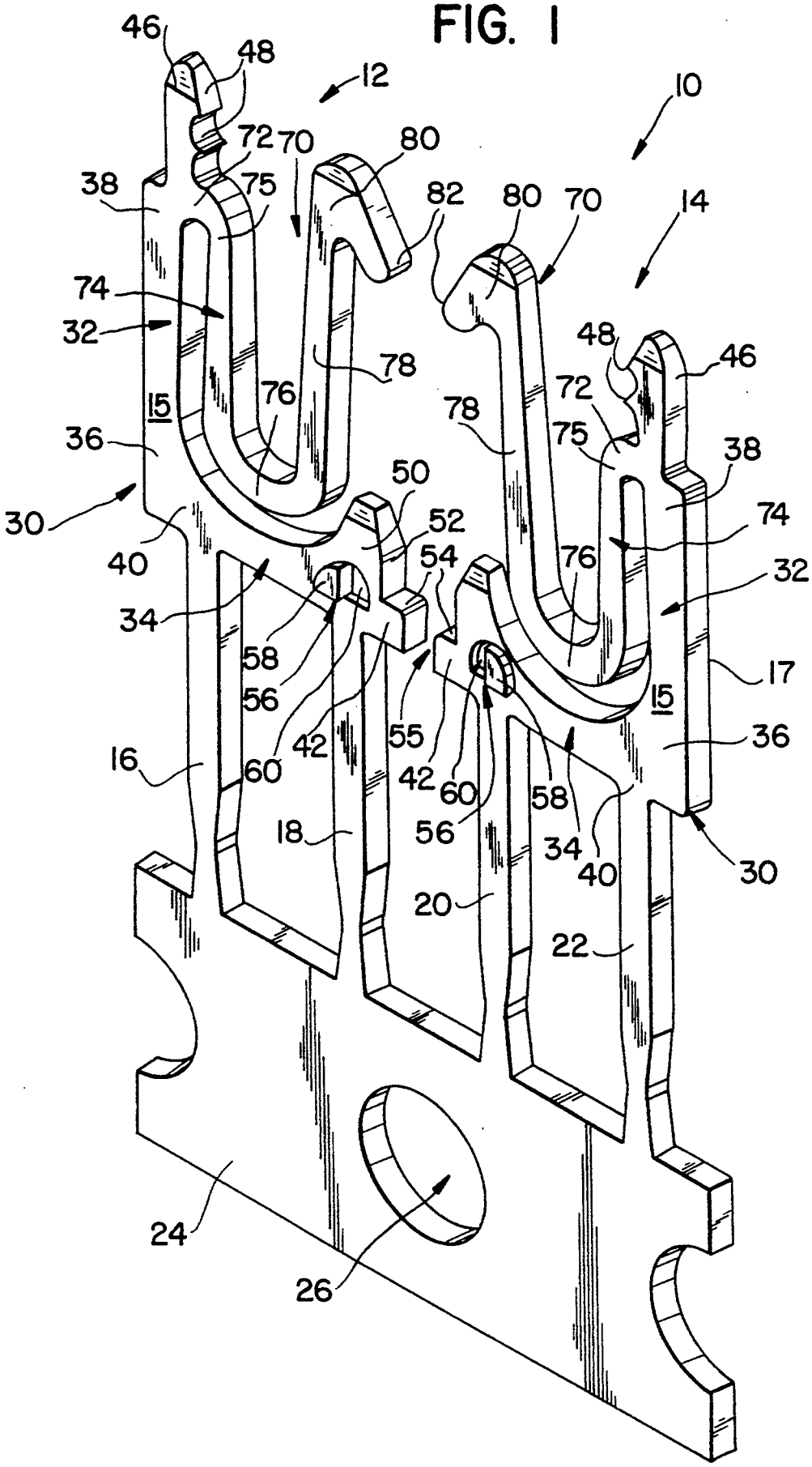
FIG. 1 is a perspective view of a pair of terminals formed according to the present invention, each terminal including a swan neck contact.
Figure 2:
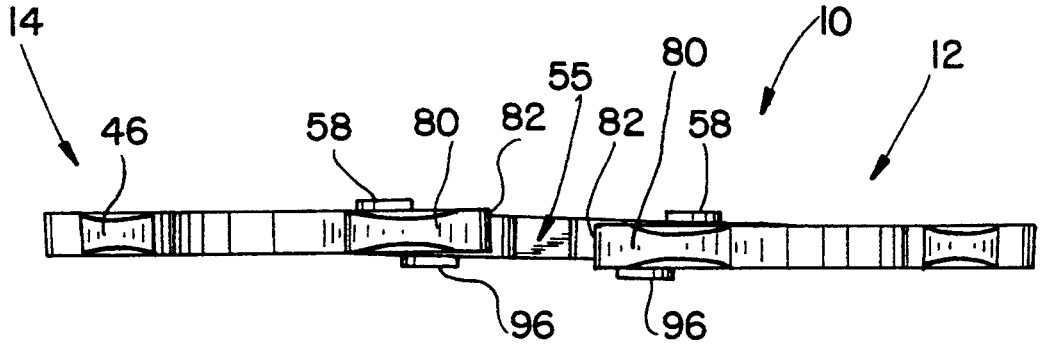
FIG. 2 is a top plan view of the pair of terminals illustrated in FIG. 1.

Referring now to the drawings, FIG. 1 illustrates a pair of terminals 10 including a first terminal 12 and a second terminal 14 which are provided for contacting conductive pads on opposite sides of a printed circuit board, module, or edge card upon insertion into a socket housing 83 as discussed below. Illustratively, the terminals 12 and 14 are stamped from a flat blank which forms both the terminals 12 and 14, two leads 16 and 18 coupled to terminal 12, two leads 20 and 22 coupled to terminal 14, and a carrier strip 24 coupled to each of the leads 16, 18, 20, and 22. Carrier strip 24 is formed to include an aperture 26 which permits the carrier strip 24 to be fed. As discussed below, selected ones of the leads 16 or 18, 20 or 22 are removed during installation of the terminals 12 and 14 into the socket housing 83 so that only a single lead 16 or 18, 20 or 22 is coupled to each terminal 12 and 14, respectively.

Terminals 12 and 14 each include a generally L-shaped base section 30 including a vertical base section 32 and a horizontal base section 34. Vertical base section 32 includes a proximal end 36 and a distal end 38. Horizontal base section 34 also includes a proximal end 40 coupled to the proximal end 36 of vertical base section 32 and a distal end 42. Terminal 12 is spaced apart from terminal 14 by a gap 55. Therefore, terminal 12 is electrically isolated or independent from terminal 14.

A retention post 46 having the shape of a half christmas tree is coupled to distal end 38 of vertical base section 32. Retention post 46 includes barbs 48 for engaging a portion 126 of the plastic housing 83 to retain the terminals 12 and 14 within the housing as discussed below with reference FIG. 5.

A projection 50 is coupled to the distal end 42 of horizontal base section 34. Projection 50 is formed to include first and second engaging surfaces 52 and 54 for engaging a central support member 94 of the housing 83 as discussed below. Engaging surface 52 of projection 50 is tapered to facilitate insertion of terminals 12 and 14 into the housing.

Figure 4:
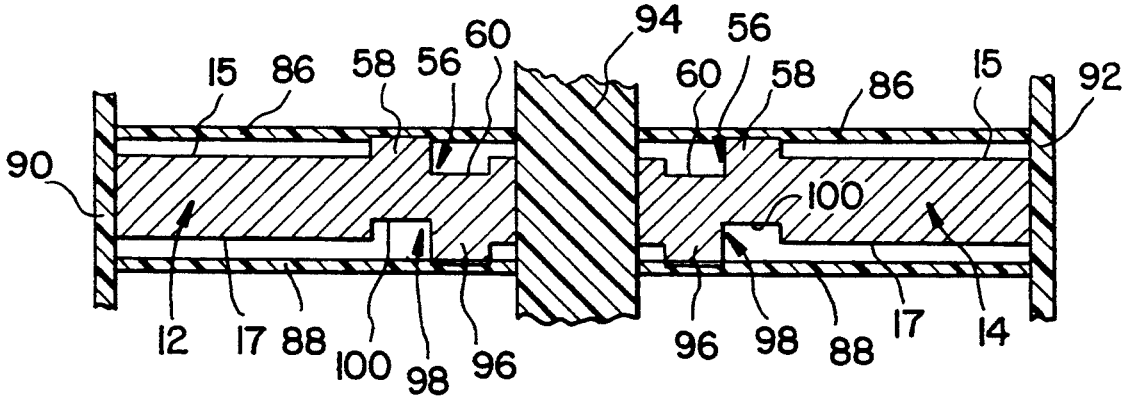
FIG. 4 is a sectional view taken through the same portion of the housing illustrated in FIG. 3 after the terminals of the present invention have been inserted into the terminal-receiving cavity.

The distal ends 42 of the horizontal base sections 34 of terminals 12 and 14 are also formed to include split dimples 56 on a first generally planar side 15 of terminals. Each split dimple 56 includes an elevated section 58 and a depressed section 60. The elevated sections 58 illustrated in FIG. 1 are formed by punching a portion of the material through from the opposite generally planar side 17 of the terminals 12 and 14. Split dimples 98 are formed on side 17 of terminals 12 and 14. The configuration and function of the split dimples 56 and 98 are best illustrated in FIG. 4. The split dimples 56 will be explained further in detail with reference to FIG. 4.

The contacts 70 of terminals 12 and 14 are swan neck contacts. Contacts 70 are coupled to distal end 38 of vertical base section 32 at locations 72. Contacts 70 each include a downwardly extending spring section 74, a generally U-shaped section 76 coupled to spring section 74, and an upwardly extending section 78 coupled to U-shaped section 76. A head 80 is coupled to an end of upwardly extending section 78. Head 80 includes a contact section 82 for engaging the conductive surfaces or pad 125 on an inserted edge card 122. Spring section 74 is tapered and includes portion 75 having a narrower cross section located near distal end 38 of vertical base section 32 and a wider cross section adjacent U-shaped section 76.

Figure 3:
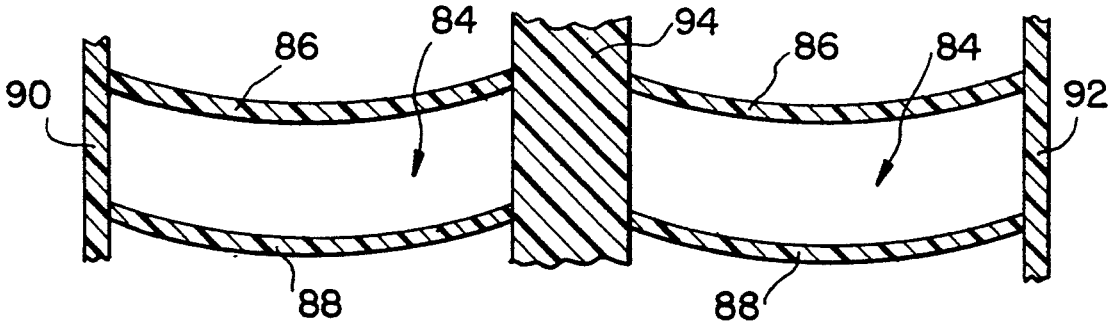
FIG. 3 is a sectional view of a portion of a SIMM socket housing for receiving the pair of terminals illustrated in FIG. 1 therein, illustrating side walls defining a terminal-receiving cavity space of the housing which have been warped due to shrinkage upon cooling of the plastic.
Figure 5:
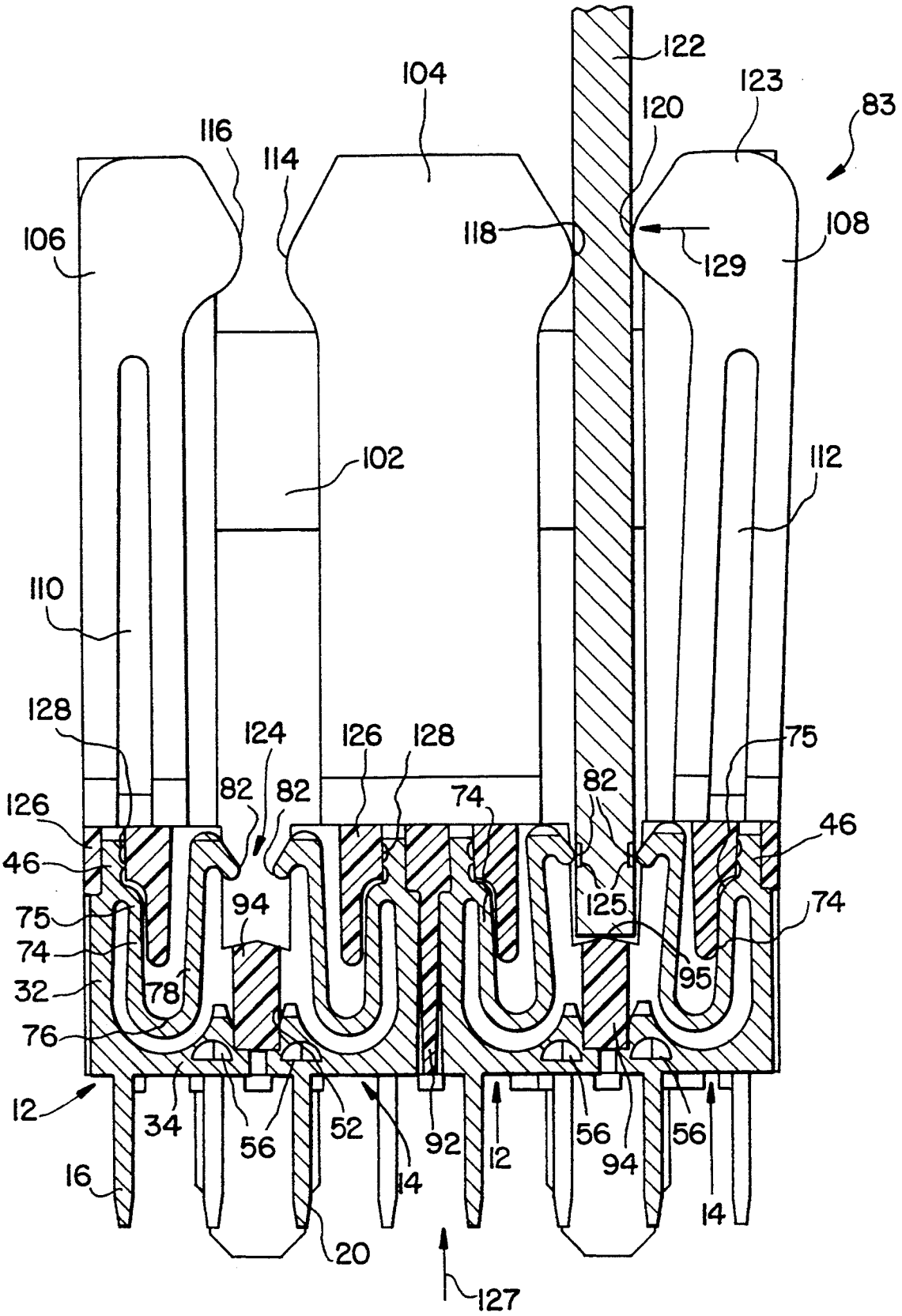
FIG. 5 is a sectional view taken through the SIMM socket illustrating the configuration of the socket housing and the configuration of the terminals after the terminals are positioned within the housing.

The configuration of the terminals 10 and the housing 83 are illustrated in FIG. 5. Housing 83 is somewhat similar to the housing illustrated in U.S. Pat. No. 5,013,264 which is assigned to the same assignee as the present invention. Each of the terminals 12 and 14 are inserted into terminal-receiving cavities 84 which open along a bottom surface-of the housing 83. As illustrated in FIG. 3., cavities 84 are formed by spaced apart partitions or walls 86 and 88, a side wall 90, and a center dividing wall 92. A central support member 94 is located between side wall 90 and center dividing wall 92. A common occurrence in the molding of plastic components such as the housing 83 is warping due to shrinkage of the plastic during the cooling process. This warpage can occur in walls 86 and 88 as illustrated in FIG. 3. This creates a "frown" in the housing 83.

As illustrated in FIG. 4, when the connector housing 83 is fully loaded with terminals 12 and 14, the frown is eliminated and walls 86 and 88 are generally parallel. During formation of terminals 12 and 14, depressed sections 60 are stamped or punched into a first side 15 of terminals 12 and 14. By punching depressions 60, material is displaced from a portion of terminals 12 and 14 to form the raised or elevated sections 96 of split dimples 98 on the side 17 opposite side 15 of terminals 12 and 14. Also during formation of terminals 12 and 14, depressed sections 100 are stamped or punched into side 17 of terminals 12 and 14. By punching depressions 100, material is displaced from a portion of terminals 12 and 14 to form the raised or elevated sections 58 of split dimples 56 on side 15 of terminals 12 and 14.

The elevated sections 58 on side 15 of terminals 12 and 14 engage or cut into the walls 86 of housing 83 to retain terminals 12 and 14 within the housing 83. Elevated sections 96 of split dimples 98 on side 17 of terminals 12 and 14 engage or cut into walls 88 of housing 83 to retain the terminals 12 and 14 within housing 83.

Larger contacts known in the prior art may include full dimples, one on each side of contact for centering and retaining the contact inside a housing. See, for example, U.S. Pat. No. 4,075,759. The split dimples 56 and 98 of the present invention advantageously permit miniaturization of the terminals 12 and 14 and provide improved centering of the terminals 12 and 14, especially in the area immediately surrounding the split dimples 56 and 98. Split dimples 56 and 98 hold terminals 12 and 14 in a central position within the terminal-receiving cavities 84 equally spaced between walls 86 and 88 of housing 83. Split dimples 56 and 98 permit terminals 12 and 14 to be manufactured at about one-fifth (1/5) the size of conventional terminals. Therefore, split simples 56 and 98 provide an advantage over known full dimples.

The configuration of the housing 83 with the terminals 12 and 14 inserted therein as illustrated in FIG. 5. The connector housing 83 includes an end wall 102, a center support post 104, and external stabilizing beams 106 and 108. External stabilizing beams 106 and 108 are each formed to include an aperture 110, 112, respectively, therein and are detached at an upper end to permit the external stabilizing beams 106 and 108 to move relative to center support post 104. Center support post 104 includes convex contact surfaces 114, 118. External stabilizing beams 106 and 108 include convex contact surfaces 116 and 120, respectively. As illustrated in FIG. 5, when an edge card 122 is inserted into the housing 83, external stabilizing beam 108 acts as a cantilevered spring. Free end 123 of external stabilizing beam 108 is deflected by insertion of edge card 122 so that the convex contact surface 120 of stabilizing beam 108 applies a force in the direction of arrow 129 toward edge card 122. This force is opposed by an equal force directed against an opposite side of the edge card 122 by internal convex contact surface 118 on center support post 104. The flexible external stabilizing beams 106 and 108 grip and hold the edge card 122 in a stable, vertical position. The combination of the stabilizing beams 106 and 108 center post 104 with the electrically independent terminals 12 and 14 provide a significant advantage over conventional SIMM sockets by reducing size while increasing the numbers of I/O leads.

As illustrated in FIG. 5, each socket 83 provides two separate upwardly opening channels or slots 124 for receiving edge cards 122. As illustrated on the left side of FIG. 5, contact sections 82 of terminals 12 and 14 extend into an insertion slot 124 of housing 83 prior to insertion of an edge card 122. A portion 126 of housing 83 is formed to include an aperture 128 therein for receiving the retention post 46 therein. The barbs 48 of retention post 46 engage the portion 126 of housing 83 to retain terminals 12 and 14 within the housing 83. In addition, as discussed above, split dimples 56 and 98 engage the housing 83 to secure the terminals 12 and 14 within housing 83. Engaging surfaces 52 and 54 abut the central support member 94 to stabilize terminals 12 and 14 further within housing 83. By having the distal end 38 of vertical base section 32 retained in housing 83 by post 46, and by having the distal end 42 of horizontal base section 34 retained in housing 83 by split dimples 56 and 98, the generally L-shaped nonmovable base section 30 is formed.

Terminals 12 and 14 are inserted into terminal-receiving cavities 84 of housing 83 from the bottom of housing 83 in the direction of arrow 127. During insertion of terminals 12 and 14, a selected lead 16 or 18 is removed from terminal 12 and a selected lead 20 or 22 is removed from terminal 14. Therefore, lead 16 provides electrical contact to terminal 12 and lead 20 provides an electrical contact to terminal 14. As discussed above, terminals 12 and 14 are electrically isolated from each other by gap 55.

In adjacent terminals, leads 18 and 22 remain on the terminals 12 and 14 so that the leads are staggered on adjacent terminals 12 and 14. In other words, a series of terminals 12 and 14 are including in housing 83. In a first terminal 12 in the series of terminals 12, lead 16 is left on terminal 12 and lead 18 is removed. On the next terminal 12 in the series, lead 18 is left on and lead 16 is removed. The alternate lead configuration is also used for terminals 14. This staggered positioning facilitates connection of the leads 16, 18, 20, 22 to a circuit board.

Contacts 70 are deflected by edge card 122 upon insertion of the edge card 122 into the insertion cavity 124. A bottom surface of edge card 122 engages a top surface 95 of central support 94 so that the edge card 122 is positioned properly in housing 83. The U-shaped sections 76 and the upwardly extending sections 78 of contacts 70 remain in substantially the same position relative to each other upon insertion of edge card 22. Movement of contacts 70 occurs only in spring arm sections 74. In particular, movement occurs in the relatively narrow section 75 located adjacent the distal end 38 of vertical base section 32.

Spring arm sections 74 apply a predetermined force so that the contact sections 82 engage conductive pads 125 on edge card 122. The forces exerted by the spring arm sections 74 against the pads 125 of edge card 122 are about one-third ($\frac{1}{3}$) the size of forces exerted by contacts in conventional SIMM sockets. This is due to the requirement for low profile miniaturization or economy of scale. Therefore, the smaller contacts 70 cannot possible exert forces as high as conventional contacts. The lower force exerted by contacts 70 requires that a precious metal plating be applied on both the pad 125 and the contact section 82. By plating pad 125 and contact section 82 with gold, for example, the performance of the contact 70 is increased over conventional SIMM socket contacts, despite the reduced forces exerted.

It is understood that although the terminals 12 and 14 find particular advantage in SIMM sockets, the terminals 12 and 14 may be used in other sockets. In the claims, the words "circuit board" are intended to cover any type of printed circuit board, module, or edge card suitable for use with electronic sockets.

Although the invention has been described in detail with reference to a certain preferred embodiment, variations and modifications exist within the scope and spirit of the invention as described and defined in the following claims.

What is claimed is:

1. A terminal for use in an electronic connector including a housing having a plurality of spaced apart walls defining a plurality of terminal-receiving cavities for establishing electrical contact with a conductive surface on a circuit board and an upwardly opening slot for receiving a circuit board therein, the terminal comprising:

a generally L-shaped base including a generally vertical first leg section aligned substantially parallel to the upwardly opening slot of the housing and a generally horizontal second leg section, the first leg section having a proximal end and a distal end, and the second leg section having a proximal end and a distal end, the proximal end of the second leg section being coupled to the proximal end of the first leg section;

first retaining means coupled to the distal end of the first leg section for retaining the first leg section of the base a terminal-receiving cavity of the housing;

second retaining means coupled to the distal end of the second leg section for retaining the second leg section of the base in the terminal-receiving cavity of the housing; and a contact including a downwardly extending section coupled to the distal end of the first leg section of the base and aligned generally parallel to the first leg section, a generally U-shaped section coupled to the downwardly extending section, and an upwardly extending section coupled to the generally U-shaped section, the upwardly extending section including a contact section for engaging a conductive surface formed on a side of the circuit board facing the first leg section of the terminal, the contact being cantilevered from the first leg section so that the downwardly extending section is movable upon insertion of the circuit board into the housing, the contact applying a biasing force to the contact section against the conductive surface of the circuit board in a direction away from the first leg section of the terminal.

2. The terminal of claim 6, wherein the first retaining means includes a retention post including a barb for engaging the housing to retain the base within the housing.

3. The terminal of claim 1, wherein the downwardly extending section is configured to have a first width dimension in close proximity to a first end of the downwardly extending section coupled to the distal end of the first leg section and a second width dimension in close proximity to a second end of the downwardly extending section adjacent the U-shaped section, the first width dimension being smaller than the second width dimension.

4. The terminal of claim 1, wherein the second retaining means includes a split dimple formed on the second leg section of the base for retaining the base within the housing.

5. The terminal of claim 4, wherein the split dimple is formed on a generally planar first side surface of the base, and further comprising a second split dimple formed on a generally planar second side surface of the base, opposite the first side surface.

6. The terminal of claim 4, wherein the base is formed to include a generally planar first side surface and a generally planar second side surface opposite the first side surface, and the split dimple includes a raised section positioned to lie above the plane of the first side surface of the base for engaging a first wall of the housing to retain the terminal in the housing, and a depressed section located adjacent the raised section, the depressed section lying below the plane of the first side surface of the base.

7. The terminal of claim 6, further comprising a second split dimple formed on the generally planar second side surface of the base portion, the second split dimple including a second raised section positioned to lie above the plane of the second side surface of the base for engaging a second wall of the housing to retain the terminal in the housing, and a second depressed section located adjacent the second raised section, the depressed section lying below the plane of the second side surface of the base portion.

8. A single in-line memory module socket for establishing electrical contact with a conductive surface on a circuit board, the socket comprising:

a housing including a first end portion, a second end portion, an upwardly opening slot extending between the first and second end portions for receiving a circuit board therein, a plurality of spaced apart walls defining a plurality of terminal-receiving cavities in the housing in communication with said slot, a first support post adjacent said slot at the first end, a second support post adjacent said slot at the second end, a first flexible beam for clamping a first end of the circuit board against the first support post to stabilize the circuit board, a second flexible beam for clamping a second end of the circuit board against the second support post to stabilize the circuit board; and a plurality of pairs of terminals, each pair of terminals including first and second terminals positioned in first and second terminal-receiving cavities, respectfully, on opposite sides of the upwardly opening slot located at the same longitudinal position relative to the housing and slot, the first terminal including a base, retaining means coupled to the base for retaining the first terminal within the first terminal-receiving cavity, and a contact coupled to the base for engaging a first conductive surface on a first side of the circuit board facing the first terminal to couple the first terminal electrically to the first conductive surface, and the second terminal including a base, retaining means coupled to the base for retaining the second terminal within the second terminal-receiving cavity longitudinally aligned with the first terminal receiving cavity on an opposite side of the slot, and contact means coupled to base for engaging a second conductive surface on a second side of the circuit board facing the second terminal to couple the second terminal electrically to the second conductive surface, the base of each of the first and second terminals including a generally vertical first leg section aligned generally parallel to the upwardly opening slot and a generally horizontal second leg section, the first leg section having a proximal end and a distal end, and the second leg section having a proximal end coupled to the proximal end of the first leg section and a distal end, the first and second contacts each including a downwardly extending section coupled to the distal end of the first leg section of the base and aligned generally parallel to the first leg section, a generally U-shaped section coupled to the downwardly extending section, and an upwardly extending section coupled to the generally U-shaped section, the upwardly extending section including a contact section for engaging a conductive surface on the circuit board, the contact being movable upon insertion of the circuit board into the housing, the second terminal being independent from the first terminal so that the first conductive surface is isolated electrically from the second conductive surface.

9. The socket of claim 8, wherein the downwardly extending section is configured to have a first width dimension in close proximity to a first end of the downwardly extending section coupled to the base portion and a second width dimension in close proximity to a second end of the downwardly extending section adjacent the U-shaped section, the first width dimension being smaller than the second width dimension.

10. The socket of claim 8, wherein each of the first and second terminals include a first split dimple formed on a generally planar first side surface of the base and a second split dimple formed on a generally planar second side surface of the base, opposite the first side surface.

11. The socket of claim 10, wherein the first split dimple includes a first depressed section formed in the first side surface of the base portion to displace a portion of the base in a direction toward the second side surface to form a raised section of the second split dimple positioned to lie above the plane of the second side surface for engaging a second wall of the housing to retain the terminal in the housing, and the second split dimple includes a second depressed section formed in the second side surface of the base portion adjacent the raised portion to displace a portion of the base in a direction toward the first side surface to form a raised section of the first split dimple positioned to lie above plane of the first side surface of the base portion adjacent the first depressed section for engaging a first wall of the housing to retain the terminal in the housing.

12. A single in-line memory module socket for establishing electrical contact with a conductive surface on a circuit board, the socket comprising:

a housing including a first end portion, a second end portion, an upwardly opening slot extending between the first and second end portions for receiving a circuit board therein, a plurality of spaced apart walls defining a plurality of terminal-receiving cavities in the housing in communication with said slot; and a plurality of pairs of terminals, each pair of terminals including first and second terminals positioned in first and second terminal-receiving cavities, respectfully, on opposite sides of the upwardly opening slot located at the same longitudinal position relative to the housing and slot, the first terminal including a base, means formed on the base for retaining the first terminal within the first terminal-receiving cavity, and a contact coupled to base for engaging a first conductive surface on a first side of the circuit board facing the first terminal to couple the first terminal electrically to the first conductive surface, and the second terminal including a base, means formed on the base for retaining the second terminal within the second terminal-receiving cavity longitudinally aligned with the first terminal receiving cavity on an opposite side of the slot, and a contact coupled to base for engaging a second conductive surface on a second side of the circuit board facing the second terminal to couple the second terminal electrically to the second conductive surface, the base of each of the first and second terminals including a generally vertical first leg section aligned generally parallel to the upwardly opening slot and a generally horizontal second leg section, the first leg section having a proximal end and a distal end, and the second leg section having a proximal end coupled to the proximal end of the first leg section and a distal end, the first and second contacts each including a downwardly extending section coupled to the distal end of the first leg section of the base and aligned generally parallel to the first leg section, a generally U-shaped section coupled to the downwardly extending section, and an upwardly extending section coupled to the generally U-shaped section, the upwardly extending section including a contact surface for engaging a conductive surface on the circuit board, the contacts being movable upon insertion of the circuit board into the housing, the second terminal being independent from the first terminal so that the first conductive surface is isolated electrically from the second conductive surface .

13. The socket of claim 12, further comprising a first support post adjacent said slot at the first end, a second support post adjacent said slot at the second end, a first flexible beam for clamping a first end of the circuit board against the first support post to stabilize the circuit board, a second flexible beam for clamping a second end of the circuit board against the second support post to stabilize the circuit board.

14. The socket of claim 12 wherein the downwardly extending section is configured to have a first width dimension in close proximity to a first end of the downwardly extending section coupled to the base portion and a second width dimension in close proximity to a second end of the downwardly extending section adjacent the U-shaped section, the first width dimension being smaller than the second width dimension.

15. The socket of claim 12, wherein each of the first and second terminals include a first split dimple formed on a generally planar first side surface of the base and a second split dimple formed on a generally planar second side surface of the base, opposite the first side surface.

16. The socket of claim 15, wherein the first split dimple includes a first depressed section formed in the first side surface of the base portion to displace a portion of the base in a direction toward the second side surface to form a raised section of the second split dimple positioned to lie above the plane of the second side surface for engaging a second wall of the housing to retain the terminal in the housing, and the second split dimple includes a second depressed section formed in the second side surface of the base portion adjacent the raised portion to displace a portion of the base in a direction toward the first side surface to form a raised section of the first split dimple positioned to lie above plane of the first side surface of the base portion adjacent the first depressed section for engaging a first wall of the housing to retain the terminal in the housing.

* * * * *